US005228877A

United States Patent [19]

Allaway et al.

[11] Patent Number: 5,228,877

[45] Date of Patent: Jul. 20, 1993

[54] FIELD EMISSION DEVICES

[75] Inventors: Michael J. Allaway, Harrow; Stuart T. Birrell, Slough; Neil A. Cade, Rickmansworth; Peter W. Green, London, all of England

[73] Assignee: GEC-Marconi Limited, England

[21] Appl. No.: 824,336

[22] Filed: Jan. 23, 1992

[30] Foreign Application Priority Data

Jan. 25, 1991 [GB] United Kingdom ..... 9101723

[51] Int. Cl.[5] ..... H01J 9/12; H01J 1/30

[52] U.S. Cl. ..... 445/24; 445/50; 156/659.1

[58] Field of Search ..... 445/24, 50, 51; 156/659.1

[56] References Cited

U.S. PATENT DOCUMENTS

| | | | |
|---|---|---|---|
| 3,755,704 | 8/1973 | Spindt et al. | 313/336 |
| 4,168,213 | 9/1979 | Hoeberechts | 156/659.1 |
| 4,943,343 | 7/1990 | Bardai et al. | 156/659.1 |
| 4,964,946 | 10/1990 | Gray et al. | 156/643 |

FOREIGN PATENT DOCUMENTS

| | | | |
|---|---|---|---|
| 0306173 | 3/1989 | European Pat. Off. . | |
| 56-160740 | 12/1981 | Japan | 445/50 |
| 1530841 | 11/1978 | United Kingdom . | |
| 1583030 | 1/1981 | United Kingdom | 445/50 |
| 2209432 | 5/1989 | United Kingdom | 445/50 |

OTHER PUBLICATIONS

Mat. Res. Soc. Symp. Proc., vol. 76, 1987, pp. 67–72, G. J. Campisi et al, "Microfabrication of field emission devices for vacuum integrated circuits using orientation dependent etching".

IEEE Transactions on Electron Devices, vol. 36, No. 11, Nov. 1989, New York, pp. 2703–2708, R. A. Lee et al., "Semiconductor Fabrication Technology Applied to Micrometer Valves".

*Primary Examiner*—Richard K. Seidel
*Assistant Examiner*—Jeffrey T. Knapp
*Attorney, Agent, or Firm*—Kirschstein, Ottinger, Israel & Schiffmiller

[57] ABSTRACT

In a method of forming a micron-size field emitter, an array of conductive tips is formed on a substrate. A layer of dielectric material is formed on the substrate to a thickness substantially equal to the height of the tips, but forming a protuberance over each tip. A conductive grid layer is deposited over the dielectric layer, forming corresponding protuberances, followed by a layer of resist material which is of sufficiently low viscosity so that it flows off the grid layer at the protuberances leaving the protuberances substantially unprotected. The grid and dielectric layers in the protuberances are then etched away to reveal the tips through the resulting apertures in the grid and dielectric layers. The apertures are thereby automatically aligned with the tips without the need for lithographic processes.

16 Claims, 4 Drawing Sheets

FIELD EMISSION DEVICES

BACKGROUND OF THE INVENTION

1. Field of the Invention

This invention relates to vacuum or gas-filled valve devices in which electrons are emitted from a cathode by virtue of a field emission process.

2. Description of Related Art

Field emitter electron sources produced by microfabrication techniques have a number of potential advantages over thermionic cathodes. Firstly, thermionic cathodes require a substantial amount of cathode heating power, which is not required by field emission sources. More especially, field emitters are capable of providing electron beams which exhibit a lower energy spread, greater uniformity and greater current density, all of which can be obtained at low voltage.

In order to achieve these capabilities, however, it is necessary to fabricate many emitters of nanometer scale uniformly over macroscopic areas.

A basic structure of a known field emitter electron source comprises, an electrically-conductive pyramid or conical shape or "tip", projecting from a substrate. There may be many such tips, for example $10^6$ or $10^8$, on a single 10 cm diameter silicon substrate.

There are various known microfabrication methods for producing such tips. For example, British Patent Publication No. 2,209,432 discloses the production of a tip (which may be one of many tips formed in a single process), depositing an insulating spacer layer and a grid layer over the tip or tips and then defining and producing a grid aperture over the or each tip by a lithographic process. Such process requires arcuate alignment of each grid aperture relative to the tip. The requirement to achieve such accuracy tends to reduce the yield of the process. U.S. Pat. No. 3,755,704 and European Patent No. 0345148 disclose the provision of a lithographically-defined grid structure through which the tips are deposited by evaporation. British Patent No. 1,583,030 discloses the formation of a grid on an array of tips formed in a unidirectional solidified eutectic. Neither of these methods requires any specially accurate alignment of separate lithographic process steps. The first method involves only one essential lithographic process, but the tips must be formed by an evaporation process. The second method requires no lithographic processes, but requires a specific, namely eutectic, form of tip material.

SUMMARY OF THE INVENTION

It is an object of the present invention to provide an improved method of producing field emitter sources and grids.

According to the invention there is provided a method of forming a field emission device, the method comprising the steps as forming an array of electrically-conductive tips on a substrate, each tip having a tip radius of a few nanometers and an apex angle less than 90°; depending on the substrate one or more dielectric layers having a total average thickness substantially equal to the tip height but exhibiting protuberances over the tips; depositing an electrically-conductive grid layer over the dielectric layer; depositing over the grid layer a layer of resist material of sufficiently low viscosity so that the resist material flows off the grid layer at the protuberances, leaving the protuberances substantially unprotected by the resist material; etching away the grid layer at each protuberance to produce a respective grid layer aperture with a collar of grid layer material therearound; and etching away the thereby exposed portions of the dielectric layer to expose the tips through the resulting apertures in the grid and dielectric layers.

Preferably the remainder of the layer of resist material is subsequently removed.

BRIEF DESCRIPTION OF THE DRAWINGS

Embodiments of the invention will now be described, by way of example, with reference to the accompanying drawings, in which FIGS. 1(*a*) to 1(*e*) are schematic sectional views illustrating stages in a first method in accordance with the invention for fabricating a field emission device, FIGS. 2(*a*) to 2(*c*) illustrate later stages in a second method in accordance with the invention, FIGS. 3(*a*) to 3(*e*) illustrate later stages in a third method in accordance with the invention, FIGS. 4(*a*) and 4(*b*) illustrate stages in a fourth method in accordance with the invention, and FIGS. 5(*a*) and 5(*b*) illustrate stages in a fifth method in accordance with the invention.

DETAILED DESCRIPTION OF THE PREFERRED EMBODIMENTS

Figure 1A:
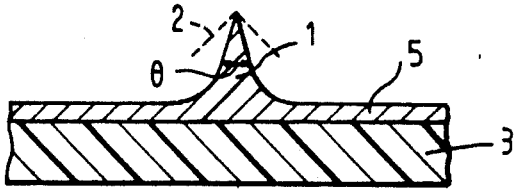
Figure 1B:
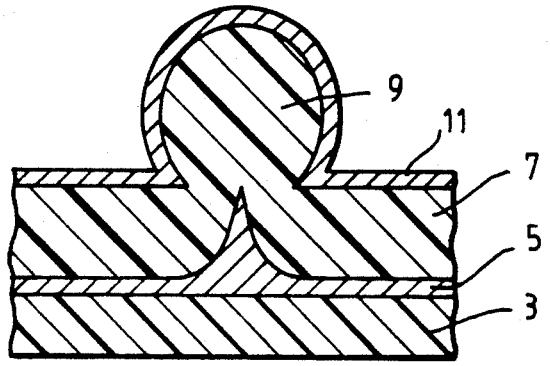
Figure 1C:
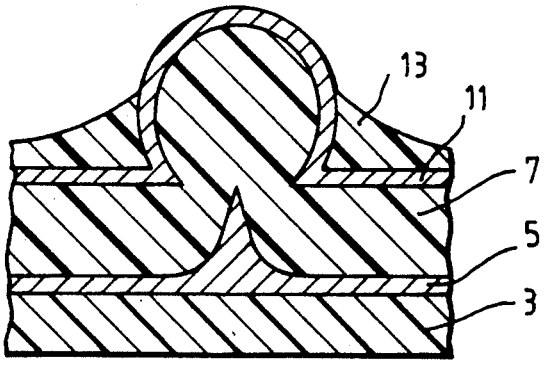
Figure 1D:
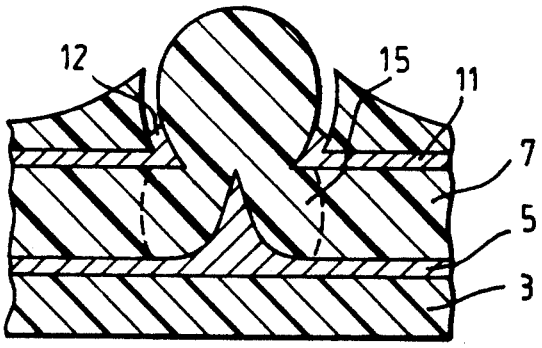
Figure 1E:
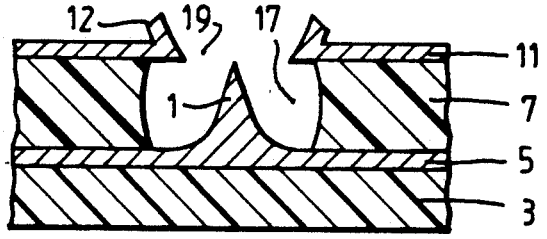

In the present invention the tip formation process occurs first, and since subsequent grid formation is self-aligned to each tip as will be explained, the tips need not be formed as a regular array. Hence, in particular, it is possible to use eutectic fibre materials such as TaC in Ni/Cr or W in $UO_3$, for example where tips are produced by selective chemical or ion beam etching to leave sharp tipped fibres of TaC or W, respectively, standing proud of the surrounding matrix.

Referring to FIG. 1, tips, such as the tip 1, are produced by coating a substrate 3, which may be of insulating material, with a conductive layer 5 of several microns thickness. The layer 5 may be patterned to form small separately-contactable areas. The tip may be formed by depositing on the conductive layer 5 a thin layer of material which is resistant to subsequent etching of the layer 5, masking a rectangular pad area of the resistant layer, and etching away the unmasked parts of the resistant layer to leave a rectangular pad of the resistant material immediately over the desired position for the emitter tip. This pad acts as a mask for subsequent etching of the layer 5, using a conventional etching process. By this process the tapered, generally pyramid-shaped emitter tip is left projecting from the remaining part of the layer 5. The pad is then removed. The etch-resistant material is chosen in dependence upon the material of the layer 5 and the etching process which is to be used. If the layer 5 is formed of silicon, a preferable etch-resistant material would be silicon dioxide, the etching process would preferably be a wet KOH etch or a dry $SF_6/O_2/Cl_2$ etch, and the masking pad would preferably be removed by hydrofluoric acid. For other layer 5 materials, the etch-resistant layer might be formed of, for example, photoresist material. Other etching processes which could be used under suitable circumstances are ion beam milling and reactive ion etching.

Preferably the tip fabrication processes are chosen to give an approximately limiting tip profile so that the sharpness of each tip does not depend critically upon the etching time. The apex angle is less than 90°, and is preferably between 30° and 60°. The sharpness of the apex angle $\theta$ of the tip 1 in FIG. 1(*a*) can be compared with a 90° angle illustrated by a dotted line 2. The tips thus formed are then protected by a thin layer of a noble metal (such as platinum) or a material with a tenacious and impervious oxide (such as a 500 Å layer of aluminium), deposited by sputtering or by evaporation, either directly on to the tips, or after another metal has been similarly deposited on the tips in order to improve adhesion or to improve the obtainable emission characteristics of the surface of the tips.

The array of tips is then coated with a layer 7 (FIG. 1(*b*)) of insulating material such as $SiO_2$, which may be doped with phosphorus or boron. For many tip materials deposition by, for example, chemical vapour deposition will lead to oxidation of the tip surface. For such materials as TiN or Pt this will not occur, and for Al only a thin (~30 Å) uniform layer of oxide will form.

The layer 7 of insulating material is deposited to a thickness comparable to the height of the tip 1, and an approximately spherical protuberance 9 of the layer 7 is found to form over the tip. A layer 11 of electrically-conductive material is formed over the insulating layer 7. The overall extent of the grid layer 11 is defined by conventional lithography at this stage.

The surface of the layer 11 is then coated with a resist layer 13 (FIG. 1(*c*)), which may be, for example, a glass-loaded (polysiloxane) polymer of a photoresist material, which may be spun and heat treated to form an etch-resistant layer. The material of the layer 13 is of relatively low viscosity, so that little or none of the resist material adheres to the layer 11 at the protuberance 9. If a thin resist layer does adhere to the protuberance, this will preferably be removed by etching, slightly reducing the thickness of the whole resist layer.

The conductive layer 11 is therefore exposed at each protuberance, but is protected by the resist material over the rest of its area. The exposed portions of the layer 11 are then etched away (FIG. 1(*d*)), leaving the projecting portions of the insulating layer 7 is exposed. A collar 12 of the material of the conductive layer 11 remains around the aperture in the layer, so that the edge of the aperture is accurately defined. After first removing the resist layer 13, for example in fuming nitric acid, the exposed portions of the layer 7 are then etched away, together with the portions immediately thereunder, leaving the tip 1 exposed through an aperture 17 in the layer 7. The etching of the layer 11 may be effected by a dry etch, and the layer 7 may be etched using a wet chemical etch, such as buffered hydrogen fluoride. Any protective layer which has been deposited on the tip may now also be removed by etching.

It will be apparent that the apertures 19 in the grid layer 11, and the apertures 17 in the insulating layer 7, are automatically accurately aligned with the tip positions, without the need for any lithographic positioning process once the tips have been formed.

The very small tip radius, which is preferably a few nanometers, enables the device to provide, with a tip to grid bias of only around 100 volts, a field strength of several gigavolts per meter as required for field emission to take place.

The material of the layer 11, which forms a grid electrode, will usually be a metal but, in order to minimise current collection by the grid and to stabilise emission from the tips, the layer 11 may preferably have a high resistance. Because the characteristic impedance of a single emitter tip is very high, for example at least 10M Ω, such a resistive layer will ideally have a comparable resistance in the vicinity of one tip. The material may be, for example, amorphous silicon or a doped insulating material. Alternatively, a high-resistance grid layer may be formed from an insulating layer the surface of which is made conductive by low energy electron or ion bombardment.

If such high resistance grid layer is provided, its performance may be improved by depositing a further metal layer which is lithographically defined and etched to form a fine mesh grid enclosing each tip. This may be formed either before or after the conductive grid layer 11 is deposited.

Figure 2A:
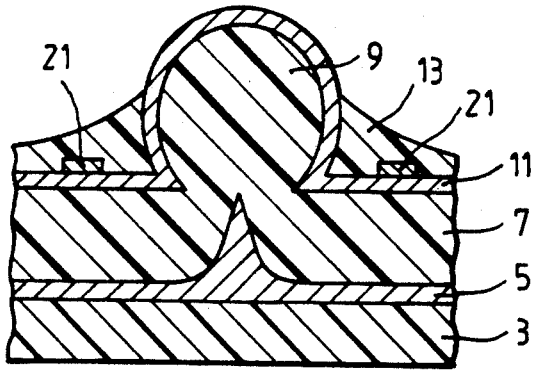
Figure 2B:
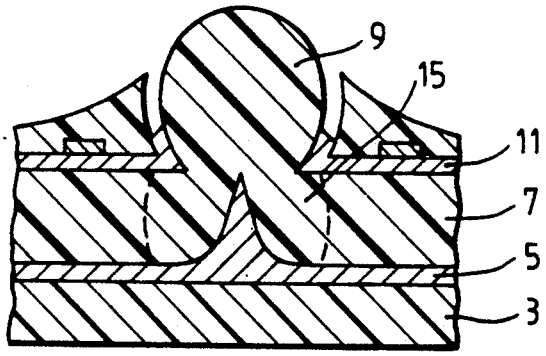
Figure 2C:
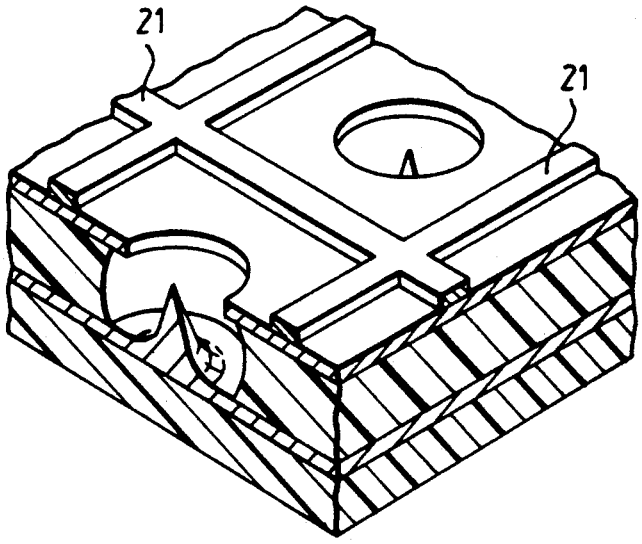
Figure 3A:
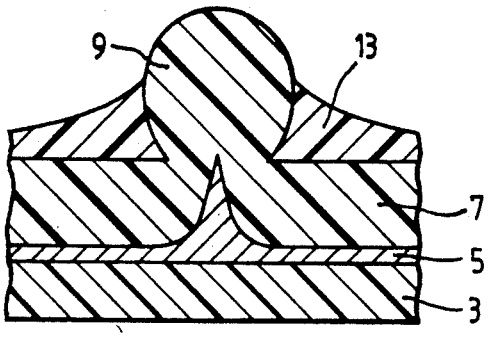
Figure 3B:
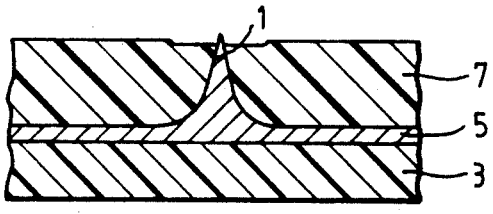
Figure 3C:
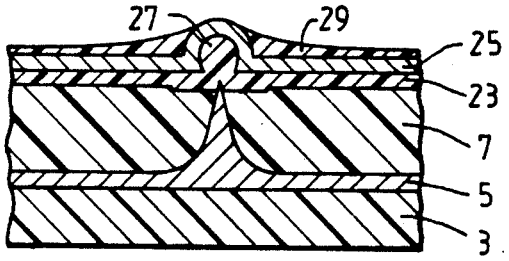
Figure 3D:
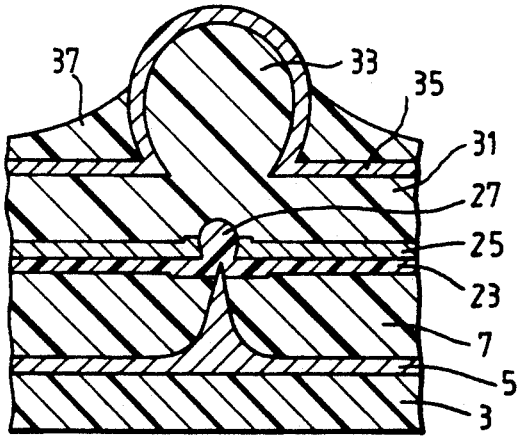
Figure 3E:
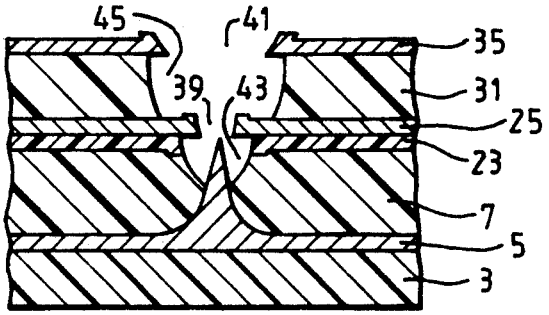

FIG. 2 illustrates, schematically, the later process steps in one method of providing such fine mesh grid. In this case, the steps shown in FIGS. 1(*a*) and 1(*b*) are first carried out. A pattern of conductors 21 is then formed on the layer 11, and the resist layer 13 is formed as previously described. The portions of the conductive layer 11 over the protuberances 9 are etched away (FIG. 2(*b*)) as before, followed by the underlying regions of the insulating layer 7. A device as shown schematically in FIG. 2(*c*) is thereby fabricated.

In order to achieve a greater degree of control over the electron beam emitted from the tip by field emission, a structure with multiple grids may be required. In an example of a method in accordance with the invention for producing such structure (FIG. 3), the first steps of FIGS. 1(*a*) and 1(*b*) are carried out, producing the protuberances 9, but without the deposition of the conductive layer 11. A resist layer 13 (FIG. 3(*a*)) is deposited, as before, but in this case the etching of the insulating layer 7 is terminated when the upper extremity of the tip 1 is just exposed (FIG. 3(*b*)). The remainder of the resist layer 13 is then removed. A further thin layer 23 of insulating material is deposited (FIG. 3(*c*)), followed by a layer 25 of conductive material to form a first grid layer. The layers 23 and 25 form a small protuberance 27 over the tip 1. A layer 29 of resist material is deposited over the layer 25, other than in the region of the protuberance, as before. The region of the conductive layer 25 at the protuberance 27 is etched away, and the remainder of the resist layer 29 is removed. The protuberance 27 of the insulating layer 23 remains.

A thicker layer 31 of insulating material is deposited over the layer 25 and over the protuberance 27. This forms a larger protuberance 33 (FIG. 3(*d*)). A second conductive layer 35 is deposited over the region 31, followed by a layer 37 of resist material as described previously. The region of the layer 35 is etched away where it is unprotected by the resist material, followed by etching of the regions of the insulating layers 31, 23 and 7 therebeneath.

The resulting structure (FIG. 3(*e*)) therefore has two grid layers 25 and 35 with apertures 39,41, respectively, therethrough, the grid layers being supported by the insulating layers 7,23 and the insulating layer 31. The apertures 39 and 41, and apertures 43,45 in the insulating layers, are all aligned with the tip 1 without the use of lithographic processes for effecting the alignment.

The basis of the method for providing multiple grids lies in the presence of a small asperity at the surface of one layer which induces the growth of a protruding sphere of insulating material when that material is subsequently deposited. Modifications of that procedure may be effected, and examples of such modifications are described below.

Figure 4A:
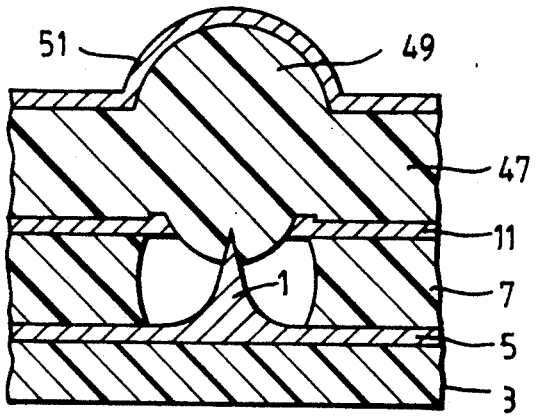
Figure 4B:
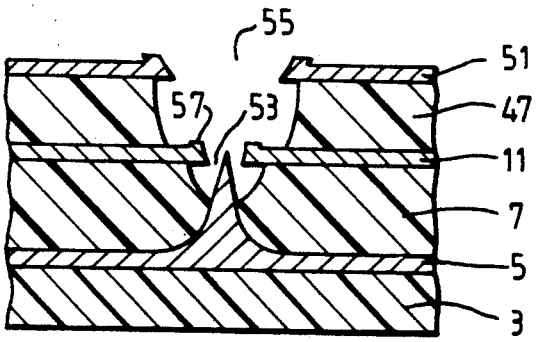

FIG. 4 of the drawings shows a stage in one such modification. The steps of FIGS. 1(*a*) to (*e*) are first carried out, producing a structure with a single grid layer 11. A layer 47 (FIG. 4(*a*)) of insulating material is then deposited over the layer 11. This layer will produce a protuberance 49 over the tip 1. A second conductive grid layer 51 is formed over the layer 49. The steps of depositing a layer of resist over the protuberance, and etching away the layers 51 and 47 in the protuberance and therebelow down to the level of the grid layer 11 are then effected as previously, resulting in a structure as shown in FIG. 4(*b*). The structure has grid layers 11 and 51 with apertures 53 and 55, respectively, therein, coaxially aligned with the tip 1. It may be advantageous to have the apex of the emitter tip 1 projecting slightly above the grid layer 11, and to ensure that the rim 57 of the aperture 53 does not project above the level of the rest of the layer 11.

Figure 5A:
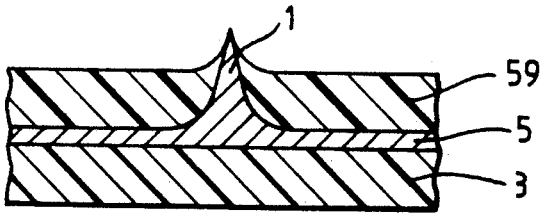
Figure 5B:
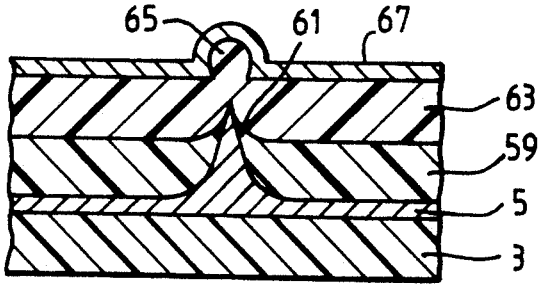

In a further alternative method a relatively small aperture can be formed in the first grid layer without the need for the planarising step of FIG. 3(*b*). This is effected by initially forming a layer 59 of insulating material (FIG. 5(*a*)) which is thinner than the height of the tip 1. This layer is formed of spun-on glass-loaded polymer (polysiloxane) and forms a thin tapered layer portion 61 over the apex of the tip 1. The layer is baked at high temperature to form a silicon dioxide insulating layer. A second insulating layer 63 (FIG. 5(*b*)) is deposited over the layer 59, forming a relatively small protuberance 65 over the tip.

A conductive layer 67, similar to the layer 25 of FIG. 3(*c*), is deposited over the layer 63, and the process steps of FIGS. 3(*c*) to 3(*e*) are then carried out.

The latter methods enable the production of structures with two grid layers from an initially single-grid structure. The process steps may be repeated to provide any number of further insulating layers and conductive grid layers. As described, the methods provide successively larger apertures in the successive grid layers of the structure. However, grid apertures of equal sizes could be obtained by sharpening the spherical protuberances of the insulating layers into tapered asperities before depositing the subsequent layers. Such tapering could be achieved by etching the protuberances using a reactive ion etching process which will not attack the surrounding conductive grid layer.

We claim:

1. A method of forming a field emission device, the method comprising the steps of: forming an array of electrically-conductive tips on a substrate, each tip having a tip radius of a few nanometers and an apex angle less than 90°; depositing on the substrate one or more dielectric layers having a total average thickness substantially equal to the tip height but exhibiting protuberances over the tips; depositing an electrically-conductive grid layer over the dielectric layer; depositing over the grid layer a layer of resist material of sufficiently low viscosity so that the resist material flows off the grid layer at the protuberances, leaving the protuberances substantially unprotected by the resist material; etching away the grid layer at each protuberance to produce a respective grid layer aperture with a collar of grid layer material therearound; and etching away the thereby exposed portions of the dielectric layer to expose the tips through the resulting apertures in the grid and dielectric layers.

2. A method as claimed in claim 1, wherein the grid layer is formed of material having a relatively high electrical resistivity.

3. A method as claimed in claim 2, wherein the grid layer is formed of amorphous silicon.

4. A method as claimed in claim 2, wherein the grid layer is formed of doped insulating material.

5. A method as claimed in claim 2, wherein a pattern of conductors is formed on the grid layer before deposition of the layer of resist material.

6. A method as claimed in claim 1, wherein the grid layer is formed of metal.

7. A method as claimed in claim 1, wherein the tips are formed of eutectic fibre material.

8. A method as claimed in claim 1, wherein the tips are coated with a thin layer of noble metal.

9. A method as claimed in claim 1, wherein the material coating the tips is aluminium.

10. A method as claimed in claim 1, wherein when the dielectric layer has been etched away just far enough to expose the tips, a second dielectric layer is deposited thereover which forms a second protuberance over the tip, followed by a second conductive grid layer, and wherein the resist formation and etching steps are repeated, whereby two grid layers with aligned apertures are formed.

11. A method as claimed in claim 1, comprising the further steps of forming a further dielectric layer over the apertured grid layer, which further dielectric layer exhibits protuberances over the tips; depositing a second conductive grid layer over the further dielectric layer; depositing a layer of resist material over the second grid layer leaving the protuberances substantially unprotected by the resist material; and etching away the second grid layer and the further dielectric layer in the protuberances to expose the tips through the resulting apertures in the grid and dielectric layers.

12. A method as claimed in claim 1, wherein for the deposition of said one or more dielectric layers a first dielectric layer is deposited on the substrate forming a thin tapered layer portion over the apex of each tip; a second dielectric layer is deposited over the first dielectric layer, the combined thicknesses of the first and second dielectric layers being substantially equal to the tip height and the second dielectric layer exhibiting relatively small protuberances over the tips.

13. A method as claimed in claim 12, wherein said first dielectric layer is spun on to the substrate.

14. A method as claimed in claim 13, wherein said first dielectric layer is formed of a glass-loaded polymer.

15. A method as claimed in claim 14, wherein the polymer is polysiloxane; and wherein the polysiloxane layer is baked before deposition of said second dielectric layer.

16. A method as claimed in claim 1, wherein the resist layer is spun on to the grid layer.

* * * * *